US005485834A

United States Patent [19]

Joye et al.

[11] Patent Number: 5,485,834

[45] Date of Patent: Jan. 23, 1996

[54] MANUALLY TUNABLE, CLOSED-CIRCUIT UNDERWATER BREATHING APPARATUS

[75] Inventors: Donald D. Joye, Exton, Pa.; William H. Mints, Bowie, Md.; John R. Clarke, Panama City, Fla.; Peter Wechgelaer, Kensington, Md.

[73] Assignee: The United States of America as represented by the Secretary of the Navy, Washington, D.C.

[21] Appl. No.: 289,022

[22] Filed: Aug. 10, 1994

[51] Int. Cl.[6] ..... A62B 9/00

[52] U.S. Cl. ..... 128/205.13; 128/204.26; 128/204.27

[58] Field of Search ..... 128/204.26, 204.29, 128/204.18, 204.27, 204.23, 204.24, 205.13; 251/129.11, 294

[56] References Cited

U.S. PATENT DOCUMENTS

| | | | |
|---|---|---|---|
| Re. 25,871 | 10/1965 | Andreasen | 128/204.28 |
| 2,483,116 | 9/1949 | Yarbrough | 128/205.12 |
| 3,046,979 | 7/1962 | Andreasen | 128/204.28 |
| 3,316,905 | 5/1967 | Seeler | 128/204.28 |
| 3,721,235 | 3/1973 | Ball et al. | 128/200.29 |
| 4,285,339 | 8/1981 | McIntyre | 128/204.23 |
| 4,840,349 | 6/1989 | Peter et al. | 251/294 |
| 4,892,286 | 6/1990 | Reinicke et al. | 251/129.11 |
| 5,315,988 | 5/1994 | Clarke et al. | 128/204.23 |

*Primary Examiner*—Edgar S. Burr
*Assistant Examiner*—V. Srivastava
*Attorney, Agent, or Firm*—A. David Spevack; William C. Garvert

[57] ABSTRACT

This invention is a manually tunable underwater breathing apparatus (UBA) in which the resonant frequency of the UBA may be adjusted to meet the diver's breathing frequency by controlling the inertance component of the UBA impedance. The principles of the present invention may be adapted to existing UBA by adding a tuning apparatus comprising a valve, a tee and a tuned length of hose. Water displaced by volume change in the breathing bag due to exhalation/inhalation is partly diverted through the valve. Depending on the valve opening set by the diver the inertance and resonant frequency of the UBA can be altered to reduce breathing load.

7 Claims, 3 Drawing Sheets

MANUALLY TUNABLE, CLOSED-CIRCUIT UNDERWATER BREATHING APPARATUS

BACKGROUND OF THE INVENTION

1. Field of the Invention

This invention relates to the field of underwater breathing apparatus (UBA), more specifically to self-contained, closed-circuit underwater breathing apparatus, which operates without need of air or breathing gas from an outside supply remote from the diver, and wherein carbon dioxide gas ($CO_2$) generated by a diver is constantly removed and oxygen ($O_2$) needed for metabolism is constantly supplied.

2. Description of the Prior Art

A closed-circuit UBA is a form of self-contained underwater breathing apparatus (SCUBA) in which a diver's breathing gas is recycled through a closed loop, adding oxygen and removing carbon dioxide gases as needed. The carbon dioxide gas is typically removed by chemical absorption. Elements of UBA typically comprise an oxygen supply bottle, a canister containing $CO_2$ absorbent, a breathing bag or flexible volume element, connecting hoses, a mouthpiece for the diver, and a diluent gas or inert gas bottle. Diluent gases such as nitrogen, inert gases such as helium, or helium/nitrogen mixtures are often used. Some UBA versions monitor $O_2$ electronically and add oxygen when inspired $O_2$ concentrations drop below desired levels. The only mechanical adjustments that can be made by a diver involve the degree of filling of the breathing bags. As ambient pressure changes, for example as the diver goes deeper or rises, the volume of gas within the breathing bag(s) contracts or expands respectively, and diluent gas may be added or dumped, either manually or automatically. Some UBA have a single breathing bag; others have one for the inhalation side and another for the exhalation side of the recirculating loop that handles the gas movement through the rig.

The closed-circuit breathing apparatus and its basic construction and principles of operation have been known for some time (U.S. Pat. No. 3,837,337 to LaViolette, 1974). Improvements to such equipment are always being made for the diving community, which includes military, commercial underwater construction and salvage, and sport divers. For example, improvements in the control of air or breathing gas flow within the apparatus are discussed in U.S. Pat. No. 4,440,166 to Winkler, et al, (1984), particularly with respect to emergency mechanical control system in the event that the electronics fails.

The majority of patents in the art center around the two critical performance factors for UBA, namely $CO_2$ absorption and $O_2$ control. Almost none deal with improving or lessening the difficulty of breathing at depth, particularly during arduous exercise or heavy work. Those that do, deal only with the fluid mechanical flow resistance and not other sources of impedance or mechanical resistance to breathing arising from the elements in the UBA including tubing or hoses, canister, etc. One exception to this is the prior invention (now U.S. Pat. No. 5,315,988 to Clarke, et al., issued May 31, 1994) by three of the inventors common to the present invention. In general, breathing resistance in a UBA can be significant for the diver; it can reduce his effectiveness or the duration of work capability, and may, more seriously, contribute to loss of consciousness.

The mechanical resistance to breathing on a UBA is complex, because the breathing is sinusoidal or periodic in nature and not a steady flow. In this kind of flow situation dynamic analyses must be employed, such as those common to the art and discussed in detail by R. Peslin and J. J. Fredberg, "Oscillation mechanics of the respiratory system", chap. 11 in Handbook of Physiology; Vol. III, *The Respiratory System,* A. P. Fishman (ed.), 1987, American Physiol. Soc., Bethesda, Md., and H. D. Van Liew, "The electrical-respiratory analogy when gas density is high", Undersea Biomedical Research, vol. 14, no. 2, (1987) pp. 149–160. In a periodic flow, allowance must be made for additional resistances to the motion of the breathing gas. These resistances are termed elastic and inertial, and they cause increased energy loss, because the diver must overcome them, as well as the resistance due to flow, to keep breathing. Inertial resistance or inertance arises from accelerations and decelerations in the gas flow or displaced water due to the periodic nature of the flow. Elastic resistance or elastance arises from pressure changes due to flow entering a closed volume or pressure changes due to volume changes (in submersed breathing bags for example). Because of the oscillatory or periodic nature of the flow, complex algebra must be used to describe the overall resistance to flow, which is termed the impedance. Therefore, for a linear model;

$$Z=R-(jE/\omega)+j\omega I \qquad \text{Eqn. 1}$$

where Z is the impedance in units of pressure/flow rate, R is the resistance due purely to flow (the flow resistance) in the same units, E is the elastance in units of pressure/volume, I is the inertance in units of pressure/flow acceleration, and ω is the radian frequency in units of reciprocal time. Eqn. 1 applies to a series arrangement of R, E and I with linear resistance, elastance and inertance, which is fundamentally typical of UBA, but other more complex models may also be used. Impedance is composed of a real part, namely the flow resistance, and an imaginary part, which is a combination of the inertance and the elastance. The magnitude of Z can be computed by;

$$|Z|=\sqrt{[R^2+(\omega I-E/\omega)^2]} \qquad \text{Eqn. 2}$$

so that all three components of impedance contribute to the pressure required to drive the flow in the system.

At the natural or resonant frequency, the inertial and elastic terms in Eqn. 2 cancel, leaving only the flow resistance contributing to the impedance. Thus impedance is at a minimal value when the system is oscillating at the natural frequency, the condition of which is given below;

$$\omega_n=\sqrt{(E/I)} \qquad \text{Eqn. 3}$$

The foregoing are terms of the art necessary to understand the present invention, but they do not constitute the invention.

Impedance in the UBA adds to the positive and negative respiratory pressures that a diver must generate to breathe. Impedance is generated by the elastance, inertance and resistance in the UBA. Resistance in UBA arises from breathing hoses, valves, changes in flow diameter, the canister and other similar obstructions in the flow path. Resistance is the fluid mechanical cost of moving a volume of fluid at a given rate. The ratio of pressure difference required to cause a given flow rate to the flow rate is termed the flow resistance.

Elastance is the reciprocal of compliance in the system and is derived in UBA primarily from changes in volume of the breathing bag when immersed. If these changes in volume lead to a vertical expansion or contraction of the bag, pressure is altered by hydrostatic forces, wherein the pressure change (ΔP) is given by;

$$\Delta P=\rho g\Delta h \quad \text{Eqn. 4}$$

where $\Delta h$ is the vertical displacement and p is the density of the ambient fluid, usually water or sea water, and g is the acceleration of gravity. The shape of the bag and its orientation in the water have an effect on the elastance. Reference is made to D. D. Joye, J. R. Clarke, N. A. Carlson and E. T. Flynn, "Formulation of Elastic Loading Parameters for Studies of Closed-Circuit Underwater Breathing Systems", NMRI Technical Report 89-89, Bethesda, Md. This reference is available from the National Technical Information Service (NTIS). Elastance is inversely proportional to the cross-sectional area that is perpendicular to the vertical direction. In general, as the breathing bag changes volume, the hydrostatic component of pressure from the top to the bottom of the bag is the elastic pressure. There are other contributions to elastance in a UBA, for example the volume of internal hoses and containers in the breathing loop, that have an additional, but much smaller, effect.

Inertance arises from the acceleration of mass in a system. The larger the mass the higher the inertance. Accelerated masses comprise breathing gases, water displaced by the breathing bag and various UBA components. Inertance (I) can be calculated from the formula:

$$I=m/A^2 \quad \text{Eqn. 5}$$

where m is mass and A is the cross-sectional area through which mass is moved, or the sectional area which moves with the mass. For a fluid moving in a tube or conduit and filling the cross-sectional area, this reduces to $\rho p L/A$, where L is the tube length and $\rho$ is the density of the fluid.

The force that moves the flow of breathing gas is respiratory pressure. Although the respiratory pressure imposed by UBA elastance can be relatively high at the low frequencies commonly encountered in a diver's breathing pattern, which is typically in the range 5–60 breaths/minute, particularly 10–40 bpm, there have been no efforts to either statically or dynamically reduce UBA elastic impedance to make it easier for the diver to breathe.

Some efforts have been made in the design of breathing machines (not UBA) that simulate human breathing or can be adjusted to generate other breathing conditions, and/or to provide adjustable impedance. Reference is made to M. Younes, D. Bilan, D. Jung and H. Kroker, "An apparatus for altering the mechanical load of the respiratory system", J. Applied Physiology, vol. 62, no. 6 (1987) pp. 2491–2499, wherein adjustment to elastance by changing gas volume in the machine is shown. Inertance is not adjusted, and oscillatory behavior is damped, not fostered.

In U.S. Pat. No. 5,315,988 to Clarke, et al., issued May 31, 1994, a reactive, closed-circuit underwater breathing apparatus is described in which tuning is accomplished continually by electronic sensing, computing and control action. In general, the tuning principles used in this invention are the same as those described therein, i.e. adjusting inertance of the UBA by changing the amount of water moved by displacement or volume changes of the breathing bag during inhalation/exhalation. Because Clarke, et al. is the work of common inventors and the present invention is a variation of the application of the same principles, the disclosure of the present invention hereby incorporates by reference Clarke, et al. to this specification, specifically from col. 1, line 1 to col. 4, line 10 and substantial portions from col. 6, line 22 to col. 8, line 28.

SUMMARY OF THE INVENTION

Accordingly, an object of this invention is to reduce the impedance in a UBA by changing the inertance so that elastic and inertial contribution to impedance cancel.

A further object of this invention is to provide a means for adjustment of the inertance in a UBA to change the natural frequency of the UBA, so that the resonant frequency of the UBA more closely matches the diver's breathing frequency, thereby minimizing impedance to breathing.

These and additional objects of the invention are accomplished by tuning a UBA. Tuning is defined as adjusting inertance so that the natural frequency of the UBA is modified to equal the breathing frequency of a diver using the UBA. Inertance is altered in a controlled manner by adjusting mass associated with motion of the breathing bag, particularly the mass of water moved by displacement of the breathing bag.

These objects are accomplished by a manually tunable underwater breathing apparatus adapted to recirculate breathing gas from a diver, absorb carbon dioxide gas, add oxygen as needed for metabolism and provide capacitance through a breathing bag, comprising a breathing bag contained in a fixed-volume container, and a means for manually changing inertance of the UBA by altering the amount of water moved by volume changes in the breathing bag during exhalation/inhalation. This differs from the objects of Clarke, et al. in that there are no computers, no position sensors, no complex electronics, and no tuning to the divers breathing frequency automatically. In the present invention, reduction of breathing load through tuning is completely under the diver's control, which is of great psychological advantage to the diver.

In one embodiment of the invention, an adjustable length tube with one end free is connected at the other end to the fixed-volume container in which the breathing bag resides. Inertance is changed by means of an actuating device which alters the length of the tube. The tube length can be lengthened or shortened by action of an initiating device such as a three-pole switch.

In a second embodiment of the invention, a fixed-length tube is connected at one end to the fixed-volume container in which the breathing bag resides. A valve, or controlled opening device, provides a means by which water can be partly diverted from moving through the robe, thereby altering the inertance. The valve can be connected to the breathing bag container or the tube through a tee fitting. Actuating means and initiating means cooperate as in the first embodiment above to change valve position and alter the amount of water diverted, hence the mass of water moving through the tube and the inertance of the system.

BRIEF DESCRIPTION OF THE DRAWINGS

A more complete appreciation of the invention will be readily obtained by reference to the following Description of the Preferred Embodiments and the accompanying drawings The representation in the figure is diagrammatic and no attempt is made to indicate actual scale, actual placement or precise ratios.

DESCRIPTION OF THE PREFERRED EMBODIMENTS

Figure 1:
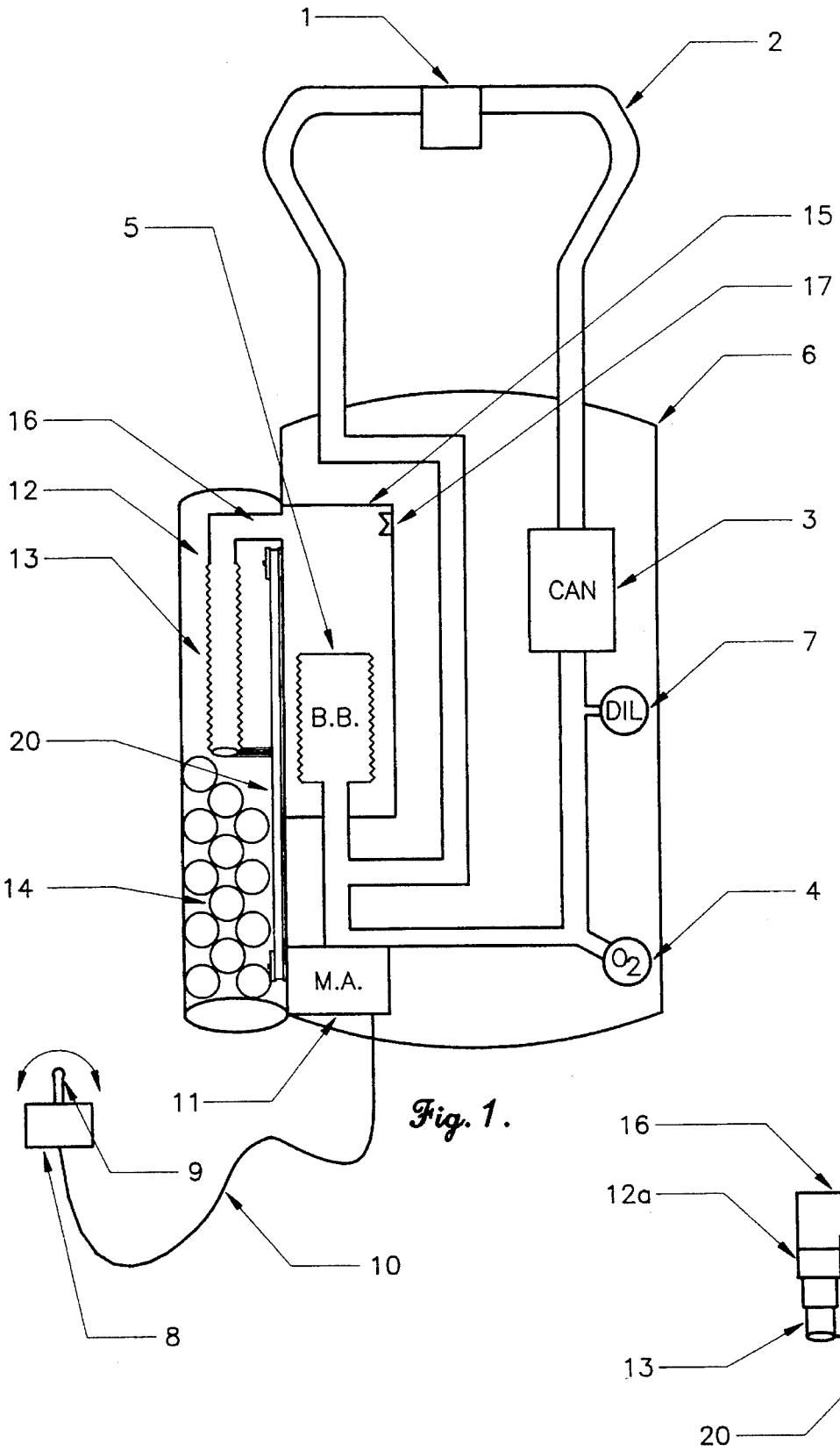
FIGS. 1 and 1(*a*) are views in schematic of a preferred embodiment of the present invention (adjustable length hose) in cooperation with the other elements of the invention in an otherwise typical closed-circuit underwater breathing apparatus.
Figure 1A:
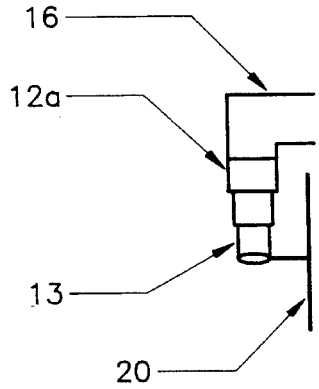

Several ways are known to the inventors for changing the mass of water moved by displacement of the breathing bag, thereby altering the inertance and making possible the reduction of breathing effort by cancelling elastance. The means for changing inertance may comprise any means selected from the following: (a) changing the mass of water displaced by motion of the breathing bag by altering the geometry of an exit hose, for example changing the length of this hose through telescoping means, attached to the breathing bag housing, a rigid, fixed-volume container in which the breathing bag moves, (b) changing the inertance of the UBA, for example adding or removing mass attached to the breathing bag or counterlung, (c) changing the geometry of the breathing bag housing by having holes placed in the housing, and having a means to open or close those holes to change the primary direction of flow of the water displaced by changes in volume of the breathing bag during exhalation/inhalation, for example axial to radial, and (d) using a valve and a fixed length of hose, wherein the valve bleeds off water in the hose by adding a parallel escape path for the water so that a portion is diverted away from moving through the hose of fixed length.

The actuating means take forms appropriate to the means for adjusting inertance. For example, if the means for adjusting inertance is the adjustable length tube, then appropriate actuating means must be used. This can comprise any means for moving one end of the tube axially, such as rack and pinion or other gear mechanism, endless cable, rotating disc and many others obvious to those skilled in the mechanical mechanism art. The actuating means may be a motor which effects motion in response to a signal from the switch, either to extend or contract the adjustable length tube, for example, or to rotate the disc clockwise or counterclockwise. If the means for adjusting inertance is the fixed-length tube with valve means for diverting a portion of the water moving in the tube, the actuating means would comprise a motorized, position-sensitive valve, which is so common in the process control, servomechanisms and other similar art.

The initiating means may comprise direct action by the diver to initiate the actuating means, for example, turning a valve wheel, crank or lever to adjust the valve opening or to change the length of a flexible, extendable hose. In a preferred embodiment the initiating means comprises an electrical three-pole switch that can be toggled between open/close/neutral settings to change the opening of a motorized valve or the length of a flexible, extendable hose. The switch can be activated by the diver at will and can work as a hold-down initiation device, where continuous operation of the actuating means is effected by holding the toggle of the switch in position, and release of the toggle to the neutral position deactivates the actuation means. Other alternatives can also be used within the scope of skill in the art.

Old UBA were designed to minimize only resistive impedance; they did not react to the diver, other than to maintain minimal inspired partial pressure of oxygen. In addition to performing all the functions of existing UBA, the new "Manually Tunable UBA" will allow the diver to reduce or minimize breathing impedance at will by tuning the UBA to resonate at the diver's respiratory frequency. This will be particularly effective where elastance is a major portion of the total respiratory impedance. Where elastance is not a major factor, tuning will not help to reduce respiratory load.

Having described the invention, the following examples are given to illustrate specific applications of the invention including the best mode now known to perform the invention. There may be other ways to do the basic tasks of the present invention, once the invention is known, thus these specific examples are not intended to limit the scope of the invention described in this application.

With reference to FIG. 1, basic elements of the UBA and features of the present invention are shown. The diver breathes on mouthpiece [ 1 ], which contains valves to control the direction of the flow. Breathing gas circulates through hose [2]; exhalation goes to the canister [3]. The $CO_2$ from the diver's exhale gas is absorbed in canister [3], make-up oxygen is added by oxygen bottle [4] as needed. The breathing bag [5] provides a capacitance in the system. Inhalation into mouthpiece [1] is from breathing bag [5]. The UBA housing [6] is generally porous to water, so ail the elements are in a water environment. Diluent gas bottle [7] for adjusting volume in the breathing bag or changing gas composition is also shown.

With respect to the elements of the present invention shown in FIGS. 1 and l(a), switch initiating means [8] with toggle [9] would most conveniently be attached to the diver's wrist via a strap. The switch [8] is connected to actuating means [11] by electrical wire [10]. Power supply is generally by battery (not shown), and this supplies all electrical power required for illumination and running of the motor in actuating means [11]. The switch [8], when activated by toggle [9] in one of two directions, sends an electrical signal to the electro-mechanical actuating means [ 11 ] which then adjusts the length of an extendable tube [12], for example a tube with bellows, as shown in FIG. 1, or a more smooth-walled telescoping tube [12*a*] shown in detail fig. 1(*a*), through mechanical connection [13] or magnetic means at the end of flexible, extendable hose [12]. Adjusting the length of the tube [12] changes the inertance of the UBA according to application of Eqn. 5. The extendable hose [12] moves in a porous housing [14] for retention and protection. The breathing bag is contained in a solid, rigid enclosure or fixed-volume compartment [ 15], so that all water displaced by the changing volume of the breathing bag is forced out hole [ 16] through hose [12]. Alternatively, for access of water, initially, to compartment [15], the compartment may be fitted with a valve [17].

Mechanical actuating means [11] may operate an endless, flexible cable, toothed belt or the like, shown in schematic by [20], fixedly attached to a moveable, outlet end of extendable hose [ 12]. The other end of extendable hose [12] is fixedly attached to the rigid, fixed-volume compartment [15] containing the breathing bag at hole [16]. Alternatively, magnetic means may be used to move the hose; or a worm gear and rack, or other mechanical linkage devices adaptable from the art may be used in place of the endless, flexible cable to change the length of extendable hose [12] by moving the hose outlet, the motion being effected by a motor, generally of the sealed electric type suitable for underwater use.

In order to return hose or shorten its length, the motor is adapted to reverse, or a spring-loaded return mechanism may be included. Other mechanisms are within the skill of the art, as it is well known that it is easier to extend a flexible member than it is to contract or compress it. For example, the tube itself can incorporate a coil-spring in the tube wall, so that it contracts by spring action when extending force is reduced or released.

Figure 2:
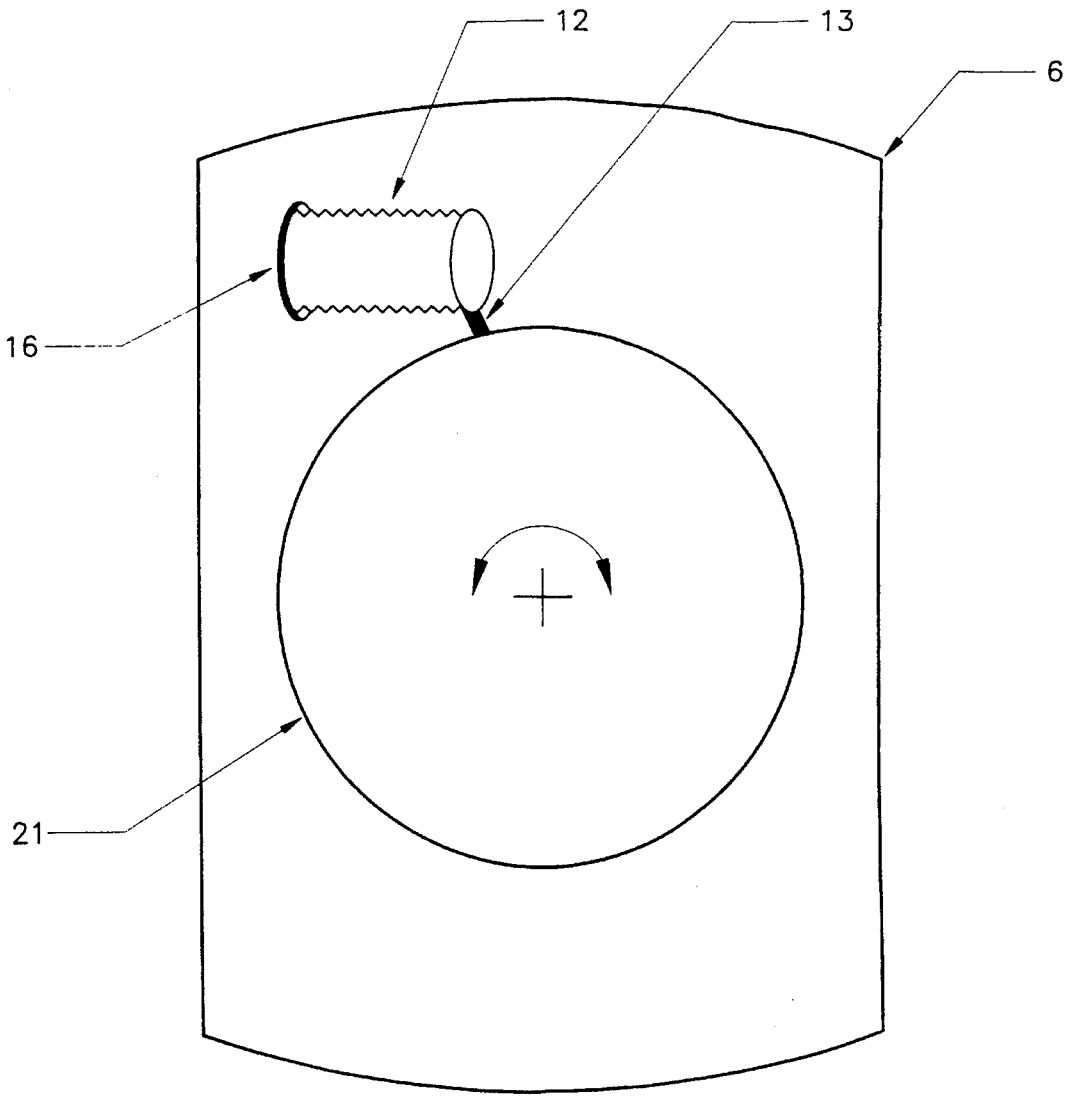
FIGS. 2 and 2(*a*) are views in schematic of a modification of the preferred embodiment of FIGS. 1 and 1(*a*), in that the flexible, extendable hose is moved by a rotating disc instead of a linear extension-retraction mechanism.
Figure 2A:
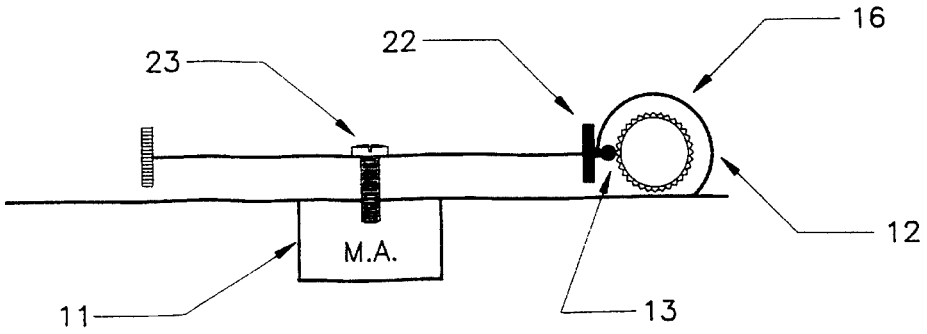

The length of extendable hose [12] may need to be longer than the shoulder-to-hip length shown in FIG. 1. In these cases alternative designs for moving the hose in a confined space can be used. For example, FIGS. 2 and 2(a) show a rotating, circular disc [21] to which a moveable end of the hose [12] is attached by mechanical linkage [13]. The rotating disc has a collar [22] at its periphery to maintain the hose at the circumference of the disc and prevent kinking or the like. Hole [16] communicates directly with the breathing bag chamber. Mechanical actuator [1] rotates the disc by turning the connecting shaft [23]. It is preferred to keep the extendable hose as close to the UBA housing as possible, primarily for ease in length adjustment, but the extendable hose in FIG. 1 can be extended around the lower back, for example, if necessary. It may also be desirable to place a rigid housing around the outer periphery of the disc to protect the hose, or such that the hose moves in a kind of tunnel similar to the protective housing [14] of FIG. 1. Design modifications in the linkage will have to be made in that event, but these and others will be modifications within the scope of the art and the present invention.

Figure 3:
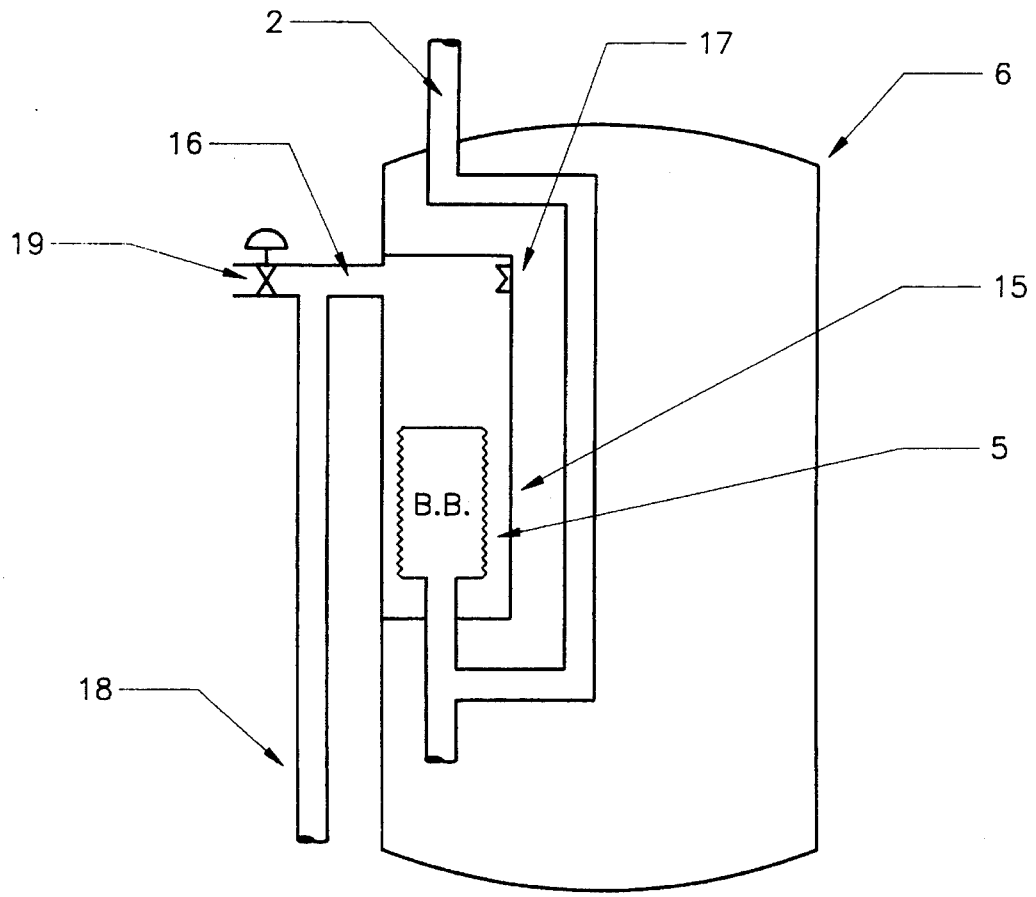
FIGS. 3 and 3(*a*) are views in schematic of another preferred embodiment of the present invention with a fixed-length hose in combination with a tee and adjustable valve.
Figure 3A:
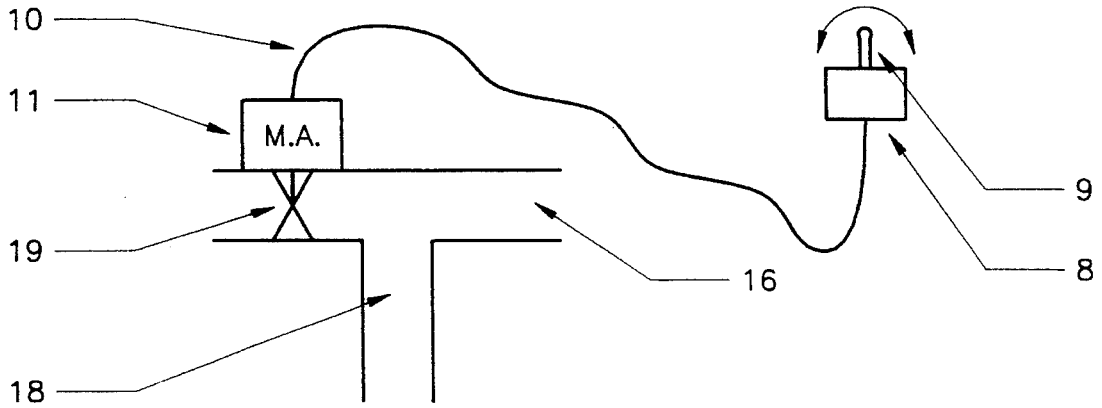

Another and particularly preferred embodiment of the present invention is shown in FIGS. 3 and 3(*a*). Exit hose [18] is a rigid, non-extendable tube of fixed length, and adjustable bleed valve [ 19] acts to change the mass of water moving through the tube by diverting a portion of the water to the outside, before it goes through the tube. As the valve is opened or closed, it can have equal, greater or less resistance than the tube. The valve is placed at one end of a tee and the fixed-length tube is attached to another end of the tee. Valve opening is controlled by hand directly or by switch [8] with toggle means [9]. Switch [8] is connected to actuating means [11] by electrical wire [10]. It is preferred to use a motorized valve familiar to the control art, but it is also feasible to operate the valve by hand through mechanical linkage, rather than through the sequence just described. In this case the valve would have to have an operating handle within easy reach of the diver, for example a turn wheel on extended shaft. to the front of the shoulder. It may be especially preferred to have a fail-safe mechanical linkage in addition to the motor. The mechanical linkage may be a turn-wheel as is most common in the art or an extended shaft turn-wheel or some other remote operation device such as a cable plus turn-wheel, so as to put the operation of the valve at the diver's fingertips, literally. As the valve is opened, a greater mass of water is diverted from moving through the tube and inertance is reduced. As the valve is closed the opposite occurs. As an alternative, the tee may be dispensed with, the tube connected directly to the breathing bag container, and valve [17] used as the adjustable bleed valve. Other alternatives will become apparent to those skilled in the art.

Experimentally we have found a tube diameter of 1.5 inches (0.038 m) or larger is suitable. By calculation, a length of 18 inches (0.46 m) with a tube diameter of 1.5 inches (0.038 m) would be sufficient to reduce breathing effort in the range of 15–30 breaths per minute by an amount in the range of 3–6 cmH2O for tidal volumes of about 1 liter. Larger gains are possible at larger tidal volumes. We have found a ball valve to be a particularly suitable valve type for its quick opening characteristics, its relatively low flow resistance, and its low turns-to-open ratio. Changing parameters, for example elastance, inertance and resistance, to effect other desired results is within the skill of the art. Another important constraint on the ability of the UBA to oscillate is to have minimal flow resistance in the path between breathing bag housing and tube exit. A high resistance here adds to the total breathing impedance and will not be able to be reduced by reactance tuning. Care must be taken to minimize this factor in the design stage, lest the benefits of tuning be lost.

The manually adjustable UBA of the present invention does not automatically tune to the diver's breathing frequency., as does the tunable UBA of Clarke, et al., hence it is distinct from that invention. The diver may prefer a frequency lower than the resonant frequency, because the presence of significant resistance in the tuning circuit may lower the minimum mouth pressure required for breathing. One of the major advantages of the present invention is the psychological benefit the diver has, when the option is available to reduce breathing load at the command of the diver. The direct mechanical control of the present invention is much simpler and far less costly than the automatically tuned version. Hence maintenance costs and expected downtime for servicing would be minimized. Reliability should be potentially much better with the simpler and more direct operation of the present invention. In brief, the present invention has advantages of control, psychological confidence, cost, simplicity and potential reliability over the tunable UBA of Clarke, et al., though the precision and automatic, "set it and forget it" aspect is lost.

Should the actuator fail, the diver would not be endangered in any of the preferred embodiments of the present invention. The valve can be made to fail open or fail closed, and in either event water from the volume change of the breathing bag will have an opening through which to escape.

A further alternative in the method of adjusting inertance described above is to substitute a solid, moveable mass, denser than water, for the water in the fixed-length tube. Water displaced by the breathing bag moves this mass, and the valve bleeds off the displaced water as above. The solid mass is attached to the housing or tube by a weak spring, and a rolling seal or other means can be used to prevent leakage of displaced water past the solid, moveable mass. The advantage of this method is that smaller, or more convenient geometries for equivalent inertance can be used.

Obviously, many modifications and variations of the present invention are possible in light of the above teachings. It is therefore to be understood that, within the scope of the appended claims, the invention may be practiced otherwise than as specifically described.

What is claimed is:

1. A manually tunable underwater breathing apparatus (UBA) adapted to recirculate breathing gas from a diver, absorb $CO_2$, add make-up oxygen, and provide capacitance through a breathing bag, comprising:

(a) a breathing bag contained in a fixed-volume container, (b) a mechanically, manually adjustable length tube with one end connected to said fixed-volume container and the other end moveable, said adjustable length tube forming the passageway for water to flow into and out of said fixed-volume container, (c) an actuating means connected to said moveable end of said adjustable length tube, such that length can be changed, and (d) a user controlled initiating means for activating said actuating means to change length of said adjustable length robe, wherein said breathing bag undergoes changes in volume from gas being exhaled or inhaled by the diver, thereby displacing water through said tube, the length of said tube giving a characteristic inertance for said UBA; changing the length by said actuating and initiating means changes the inertance and thereby the resonant frequency of said UBA to lessen the breathing load on the diver.

2. The manually tunable UBA of claim 1, wherein said actuating means is selected from the group consisting of an endless cable, a rack and pinion gear, a rotating circular disc, and said initiating means is a switch which energizes a motor in said actuating means to extend or contract said adjustable length tube depending upon switch setting.

3. The tunable UBA of claim 1, wherein said actuating means is selected from the group consisting of an endless cable, a rack and pinion gear, a rotating circular disc, and said initiating means is direct manual manipulation by the diver, causing said actuating means to move said adjustable length tube in the desired direction.

4. The manually tunable UBA of claim 1, wherein said adjustable length tube is contained in a rigid, porous housing, so that water can move easily therethrough, and protection is afforded to said tube.

5. A manually tunable underwater breathing apparatus (UBA) adapted to recirculate breathing gas from a diver, absorb $CO_2$, add make-up oxygen, and provide capacitance through a breathing bag, comprising:

(a) a breathing bag contained in a fixed-volume container, (b) a fixed-length tube with one end connected to said fixed-volume container, so that water can flow therethrough, (c) a hand actuated valve connected to said fixed-volume container, and (d) an initiating means employing direct manual manipulation by a diver for activating said hand actuated valve to change the opening of said valve such that the mass of water displaced by volume change of said breathing bag and moving through said fixed-length tube is altered by said valve, thereby changing UBA inertance, natural frequency and reducing a diver's breathing effort.

6. The manually tunable UBA of claim 5, wherein said hand actuated valve is a motorized valve and said initiating means is a switch controlled by a diver which energizes the valve motor, causing the valve to open or close a desired amount.

7. The manually tunable UBA of claim 5, wherein said valve is connected to said fixed-volume container through a tee fitting, taking two of the three openings of the tee, and said fixed-length tube taking the third.

* * * * *